United States Patent [19]

Yates

[11] Patent Number: 4,758,188

[45] Date of Patent: Jul. 19, 1988

[54] CLAMP-LIKE ELECTRICAL CONNECTOR

[75] Inventor: Herbert Yates, Montreal, Canada

[73] Assignee: MYL Developments, Ltd., Beaconsfield, Canada

[21] Appl. No.: 39,329

[22] Filed: Apr. 17, 1987

[51] Int. Cl.[4] ..... H01R 4/48

[52] U.S. Cl. ..... 439/759; 439/772; 439/510

[58] Field of Search ..... 439/504, 503, 509, 510, 439/513, 756, 759, 772, 773

[56] References Cited

U.S. PATENT DOCUMENTS

| | | | |
|---|---|---|---|
| 2,000,665 | 5/1935 | Neal | 439/510 |
| 3,028,577 | 4/1962 | Strauss | 339/255 |
| 3,124,347 | 3/1964 | Haddad | 269/91 |
| 3,267,452 | 8/1966 | Wolf | 340/249 |
| 3,678,450 | 7/1972 | Azamber et al. | 439/759 |
| 3,988,051 | 10/1976 | Robinson | 339/238 |
| 4,385,796 | 5/1983 | Eriksson | 439/772 |
| 4,449,772 | 5/1984 | Johnson, III | 339/29 B |
| 4,453,791 | 6/1984 | Ledbetter | 339/29 B |
| 4,475,728 | 10/1984 | Haddad | 269/94 |
| 4,620,767 | 11/1986 | Woolf | 339/29 B |
| 4,640,563 | 2/1987 | LeBlanc | 339/29 B |

FOREIGN PATENT DOCUMENTS

| | | | |
|---|---|---|---|
| 1250519 | 9/1967 | Fed. Rep. of Germany | 439/773 |
| 0572866 | 9/1977 | U.S.S.R. | 439/773 |

*Primary Examiner*—Eugene F. Desmond
*Assistant Examiner*—Paula A. Austin
*Attorney, Agent, or Firm*—Chilton, Alix & Van Kirk

[57] ABSTRACT

The jaws of the clamp are pivoted towards each other in a locked position of the clamp by a toggle arrangement. An electrical connection between the jaws of the clamp and the cable are effected only when the clamp is in its locked position.

9 Claims, 2 Drawing Sheets

CLAMP-LIKE ELECTRICAL CONNECTOR

BACKGROUND OF INVENTION

1. Field of the Invention

The invention relates to a clamp-like electrical connector. More specifically, the invention relates to a connector clamp which is mounted at one end of a conductor cable, for example, a conductor clamp for a battery booster cable.

2. Description of Prior Art

Conductor clamps for booster cables are known in the art as illustrated in, for example, U.S. Pat. No. 3,267,452, Wolf, Aug. 16, 1966, U.S. Pat. No. 4,449,772, Johnson, III, May 22, 1984, U.S. Pat. No. 4,453,791, Ledbetter, June 12, 1984, U.S. Pat. No. 4,620,767, Woolf, Nov. 4, 1986, U.S. Pat. No. 4,640,563, LeBlanc, Feb. 3, 1987.

In all of the illustrated references, the clamps include two jaw members which are pivotally attached to each other. The jaw members extend to handles, and the jaws are spring biased towards each other. In the operation of the illustrated devices, the handles are pressed together to open the jaws and the jaws are then placed around a terminal. The handles are then released whereby the spring forces the jaws against the terminals. For example, in the U.S. Pat. No. 3,267,452, the jaws 13 and 14 extend to handles 10 and 11 respectively. Springs 17, 18 biases the jaws towards each other.

It is well known that the connector clamps of the prior art are subject to slippage and are therefore inconvenient in use. In addition, because the springs of the prior art clamps are in a permanently biased position, the spring tends to loosen in time so that the clamps are no longer useful.

In addition, in the prior art clamps, there is a permanent electrical connection between the jaw members and the cables extending from the handles. Thus, considering once again the U.S. Pat. No. 3,267,452, when the clamps 41 and 43 are connected to a battery as shown in FIG. 5, then the clamps 40 and 44 are live. If someone inadvertently held the two clamps by their electrical conductive portions, then they would get a shock. Also if the clamps 40 and 44 came together inadvertently, then they would spark and discharge the battery.

SUMMARY OF THE INVENTION

It is therefore an object of the invention to provide a connector clamp which overcomes the disadvantage of the prior art connector clamps.

It is a further object of the invention to provide a conductor clamp wherein the locked position of the clamp is effected by a toggle action.

It is a still further object of the invention to provide a connector clamp wherein electrical connection between the jaw members and the cable is effected only when the clamp is in its locked position.

In accordance with the invention there is provided a connector clamp for mounting at an end of an electrically conductive cable and comprising a first jaw member and a second jaw member pivotally connected to the first jaw member such that the jaw members are pivoted towards each other in a locked position of the clamp and pivoted away from each other in an open position of the clamp. In accordance with the invention, toggle means are provided for locking the clamp in the locked position.

Further, in accordance with the invention there is provided a connector clamp for mounting at the end of an electrically conductive cable comprisng a first jaw member and a second jaw member pivotally connected to the first jaw member such that the jaw members are pivoted towards each other in a locked position of the clamp and pivoted away from each other in an open position of the clamp. In accordance with the invention, means are provided for effecting electrical connection between the jaw members and the clamp when the clamp is in the locked position, and for breaking the electrical connection when the clamp is in the open position.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
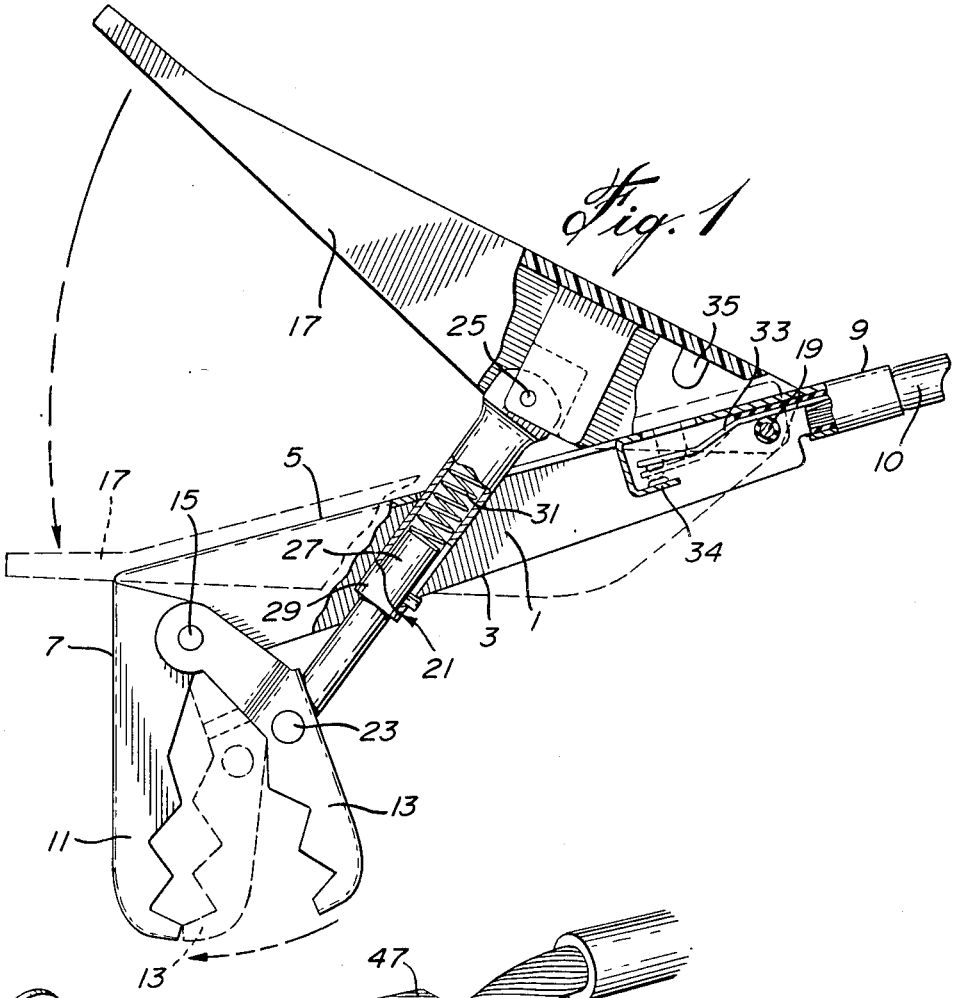
FIG. 1 is a side view of one embodiment of the invention.

Referring to FIG. 1, a clamp in accordance with the invention includes an elongated base member 1 which is made of a conductive material and which has a bottom side 3 and a top side 5. The elongated base member also has a first end 7 and a second end 9. The base member 1 is hollow, and the conductive cable 10 extends into the base member through the second end 9.

Extending downwardly from the bottom end of the base member is a first jaw member 11. A second jaw member 13 is pivotally connected to the first jaw member 11 at first pivot point 15.

The clamp also includes an elongated handle 17 which is made of plastic or other insulating material and which is pivotally connected at the second end of the base member 1 at second pivot point 19.

A rod member 21 is pivotally connected to the second jaw member 13 at third pivot point 23, and is pivotally connected, at the other end thereof, to the handle member 17 at fourth pivot point 25. The rod member includes a rod 27 which is slidable in sleeve 29. It also includes a helical spring 31 surrounding the rod 27. The rod extends from the second jaw 13 to the handle 17 through an opening (not shown) in the top side 5 of the base member 1.

In operation, the clamp is in its open position when the handle is pivoted so that its free end is spaced from the base member 1 as shown in full lines in Figure 1. The handle is in its locked position when it is pivoted downwardly to abut the base member 1 as shown in dotted lines in FIG. 1. With the handle down, the second jaw member 13 is moved towards the first jaw member 11 as also shown in dotted lines in FIG. 1.

Figure 2:
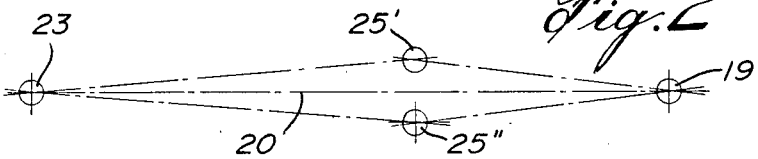
FIG. 2 is a chart for explaining the toggling action of the inventive clamps.

In order to effect the toggle action for locking the clamp in its locked position, the fourth pivot point 25 is arranged so that it will be on one side of the line joining pivot points 19 and 23 when the clamp is in its open position, and on the other side of that line when the clamp is in its locked position. This is illusrated in FIG. 2.

With the clamp in its open position, spring 31 pushes the handle 17 away from the second jaw member 13 so that if the handle is pivoted only partially downward and then released, the handle will be pushed by the spring 31 to its full open position as shown in FIG. 1. When pivot point 25 moves below the line between pivot points 19 and 23 (25" in FIG. 2), then spring 31 pushes second jaw member 13 away from the handle 17 to thereby force the jaw into its locked position.

It is noted that first jaw member 11 is fixedly connected to the base member 1, for example, by being integrally formed therewith. Both the jaw members and the base member are made of an electrically conductive material so that the jaw members are in electrical connection with the base member. As above described, in the prior art, the cables are permanently electrically connected to the jaw members. In an embodiment of the invention which provides an improvement over the prior art, means are provided for effecting electrical connection between the jaw members and the conductor cable only when the clamp is in its locked position.

Returning to FIG. 1, the means for effecting the electrical connection comprise a sprung contact 33, which is electrically connected to cable 10, a pusher rod 35 and a contact 34, electrically connected to jaw members 11 and 13 through base member 1. The pusher rod is surrounded by a spring 31.

As can be seen, when the handle is pivoted downwardly to its locked position, the contact 33 will engage the contact 34 so that there will be electrical connection between the jaw members 11 and 13 and the cable 10. When the handle is in the open position, the contact 33 is spaced from the contact 34 so that there is no electrical connection between the jaw members 11 and 13 and the cable 10.

Figure 4:
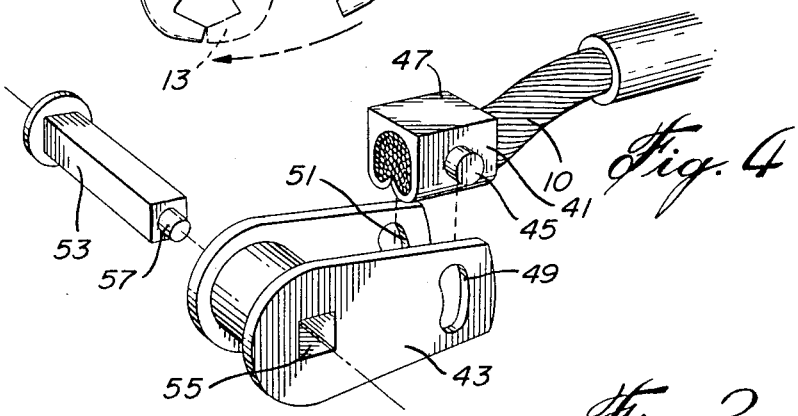
FIG. 4 shows details of parts of the embodiment of FIG. 3.
Figure 3:
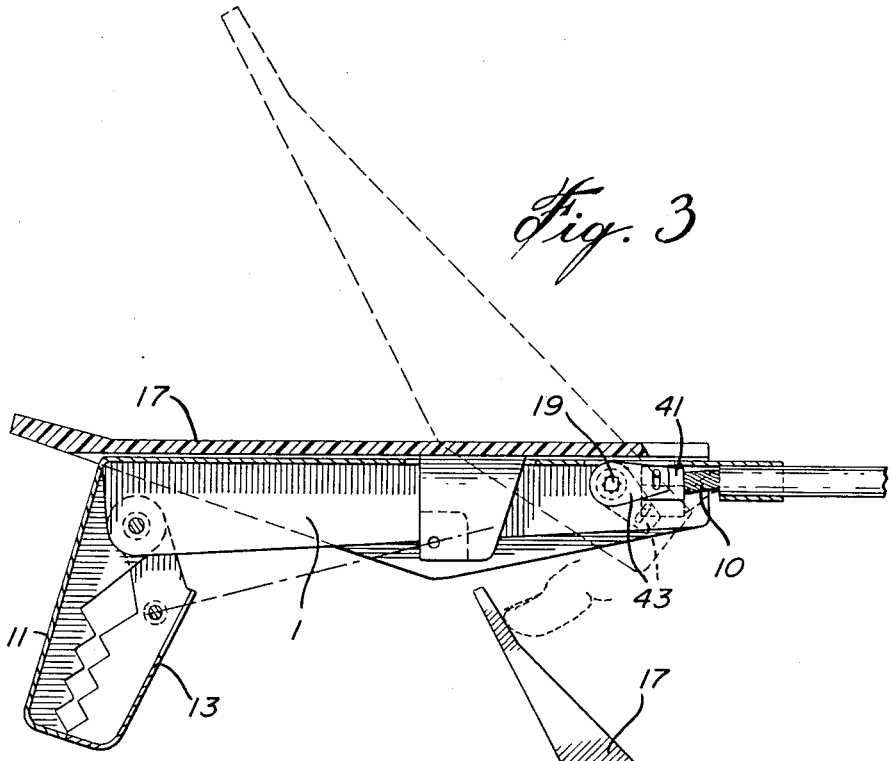
FIG. 3 illustrates a second embodiment of the invention.

An alternate arrangement for effecting an electrical connection is illustrated in FIGS. 3 and 4. As can be seen, contact member 41, carried by a contact carrier 43 is mounted at the pivot point 19 on the handle 17 on the base member 1. The contact member is physically and electrically connected to the cable 10. It includes axles 45 and 47 on either side thereof which are disposed for sliding movement in slots 49 and 51 on either side of the carrier 43.

The carrier also includes an axle 53 which, in cross-sectional shape, includes side edges, for example, the cross-sectional shape is a square. The axle is disposed in opening 55 which extends across the carrier member 43 and whose shape is the same shape as the cross-sectional shape of the axle 53. In view of the sharp edges of the shapes, the carrier member 43 will rotate with the axle 53.

Extension 57 of axle 53 is connected to the handle member 17 so that axle 53 rotates with the pivoting of the handle 17.

As seen in FIG. 3, when the handle is in its open position as shown in chain lines, the contact 41 is spaced from the base member 1. Accordingly, there is no connection between the jaw members 11 and 13 and the cable 10.

Figure 5:
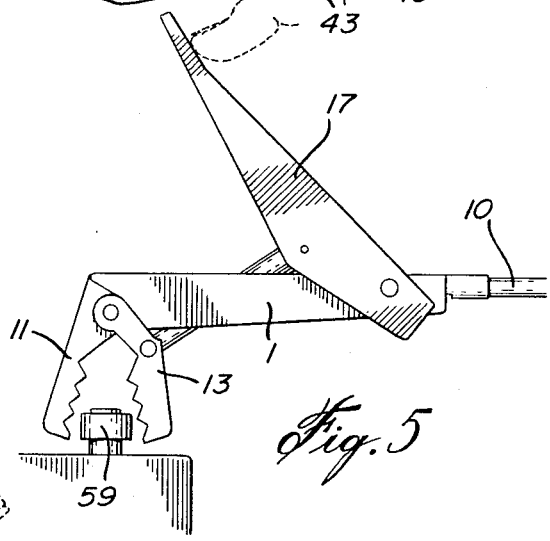
FIGS. 5 and 6 illustrate the operation of the inventive clamp.
Figure 6:
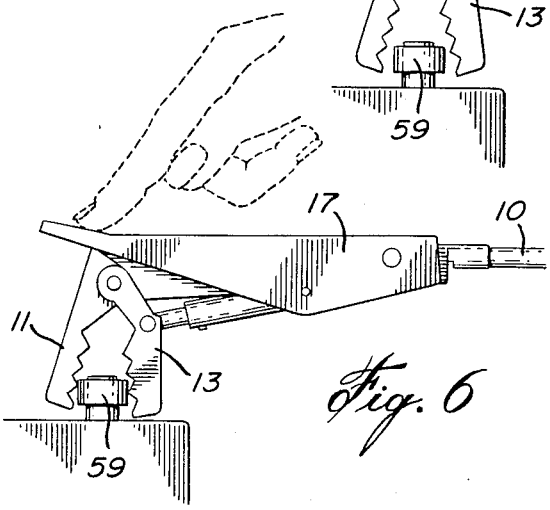

When the clamp is in its locked position, as shown in solid lines in FIG. 3, the contact 41 is in physical, and therefore an electrical, connection with the base member 1. Accordingly, the jaws 11 and 13 are electrically connected, through electrically conductive base member 1, to the cable 10. Referring to FIGS. 5 and 6, in operation, the jaws 11 and 13 are disposed so that they are on either side of a terminal 59 to which it is desired to effect electrical connection. The handle member is pushed downwardly so that the fourth pivot point is below the line between the second and third pivot points as shown at 25" in FIG. 2. Accordingly, the clamp is firmly fixed to the terminal 59.

When the clamp includes a means for effecting electrical connection between the jaws and the cable, there will be electrical contact between the terminal 59 and the cable 10 only when the clamp is in its locked position.

Although several embodiments have been described, this was for the purpose of illustrating, but not limiting, the invention. Various modifications, which will come readily to the mind of one skilled in the art, are within the scope of the invention as defined in the appended claims.

I claim:

1. A connector clamp for mounting at an end of an electrically conductive cable, comprising:

a longitudinally extending base member having a top side, a bottom side and a first end and a second end, and being hollow, said cable extending into said base member through the second end thereof;

a first jaw member extending downwardly from the bottom side of said base member and fixedly connected to said base member at a junction at the first end of said base member;

a second jaw member extending downwardly from the bottom side of said base member and pivotally connected to said base member at a first pivot point at the junction of said base member and said first jaw member;

a longitudinally extending handle member pivotally connected to said base member at a second pivot point at the second end of said base member such that said handle member overlies said base member;

a rod member having a first end and a second end, said first end of said rod member being pivotally connected to said second jaw member at a third pivot point, said second end of said rod member being pivotally connected to said handle member at a fourth pivot point;

a spring means on said rod member between said second jaw member and said handle member;

whereby, when said handle member is pivoted towards said base member to abut said base member, said second jaw member is forced toward said first jaw member in a locked position of said clamp; and when said handle member is pivoted away from said base member, said second jaw member is spaced from said first jaw member in an open position of said clamp.

2. A clamp as defined in claim 1 wherein said first and second jaw members are made of an electrically conductive material and wherein said base member is made of an electrically conductive material whereby said base member is electrically connected to said first and second jaw member;

means for effecting electrical connection between said cable and said base member at least when said clamp is in said locked position.

3. A clamp as defined in claim 2 wherein said means for effecting electrical connection comprises a switch which is closed when said handle member abuts said base member and which is open when said handle member is spaced from said base member.

4. A clamp as defined in claim 2 wherein said means for effecting electrical connection comprises:

a contact member physically and electrically connected with said cable;

a carrier for said contact member;

said carrier being mounted in said base member at said second pivot point;

said carrier being connected to said handle member to rotate when said handle member pivots;

whereby, when said handle member is in a locked position of said clamp, said contact member is physically connected with said base member whereby said first and second jaw members are electrically connected with said cable; and said handle member is in the open position of said clamp, said contact member is spaced from said base member, whereby said first and second jaw members are not electrically connected with said cable.

5. A clamp as defined in claim 1 wherein said pivot points are arranged so that the fourth pivot point is on one side of the line connecting the second pivot point to the third pivot point when the clamp is in its open position, and the fourth pivot point is on the other side of the line connecting said second pivot point to said third pivot point when the clamp is in its locked position;

whereby, in the locked position, the second jaw is forced towards said first jaw by a toggle action.

6. A clamp as defined in claim 5 wherein said rod member comprises a rod pivotally connected at one end thereof at said fourth pivot point;

a sleeve;

the other end of said rod extending into one end of said sleeve;

the other end of said sleeve being pivotally connected at said third pivot point;

said spring means comprising a helical spring being wound around said rod.

7. A connector clamp for mounting at an end of an electrically conductive cable, comprising:

a first jaw member and a second jaw member pivotally connected to said first jaw member such that said jaw members are pivoted towards each other in a locked position of said clamp, and pivoted away from each other in an open position of said clamp;

means for effecting electrical connection between said jaw members and said cable when said clamp is in said locked position and, for breaking said electrical connection when said clamp is in said open position;

said means for effecting electrical connection and breaking said electrical connection comprising switch means.

8. A clamp as defined in claim 7 wherein said switch means comprises a contact member which makes physical and electrical contact with said cable when said clamp is in said locked position, and which is spaced from said cable and electrically disconnected therefrom when said clamp is in said open position.

9. A connector clamp for mounting at an end of an electrically conductive cable, comprising:

a longitudinally extending base member having a first end and a second end;

a first jaw member and a second jaw member pivotally connected to said first jaw member such that said jaw members are pivoted towards each other in a locked position of said clamp, and pivoted away from each other in an open position of said clamp, said first and second jaw members being connected to said first end of said longitudinally extending base member;

a longitudinally extending handle member pivotally connected to said base member at the second end of said base member; and toggle means for locking said jaw members in said locked position;

said toggle means including a rod member having a first end and a second end, said first end of said rod member being pivotally connected to said second jaw member, said second end of said rod member being pivotally connected to said handle member;

spring means on said rod member between said second jaw member and said handle member.

* * * * *